US008791380B2

(12) United States Patent
Shimoda et al.

(10) Patent No.: US 8,791,380 B2
(45) Date of Patent: Jul. 29, 2014

(54) ACCELERATION SWITCH AND ELECTRONIC DEVICE

(75) Inventors: Sadashi Shimoda, Chiba (JP); Kazuo Toda, Fukushima (JP)

(73) Assignees: Seiko Instruments Inc. (JP); Kazuo Toda (JP)

( * ) Notice: Subject to any disclaimer, the term of this patent is extended or adjusted under 35 U.S.C. 154(b) by 0 days.

(21) Appl. No.: 13/582,106

(22) PCT Filed: Mar. 2, 2011

(86) PCT No.: PCT/JP2011/054682

§ 371 (c)(1),
(2), (4) Date: Dec. 7, 2012

(87) PCT Pub. No.: WO2011/108559

PCT Pub. Date: Sep. 9, 2011

(65) Prior Publication Data

US 2013/0081930 A1 Apr. 4, 2013

(30) Foreign Application Priority Data

Mar. 3, 2010 (JP) ..... 2010-065062

(51) Int. Cl.
*H01H 35/02* (2006.01)

(52) U.S. Cl.
USPC ..... 200/61.45 R

(58) Field of Classification Search
CPC ... H01H 35/145; H01H 35/14; H01H 35/141; H01H 1/0036; H01H 35/144; H01H 35/10
USPC ..... 200/61.45 R, 61.46, 61.52, 61.53, 61.55; 307/121; 350/669
See application file for complete search history.

(56) References Cited

U.S. PATENT DOCUMENTS

| | | | | |
|---|---|---|---|---|
| 2,503,950 | A * | 4/1950 | Johnson | 200/80 R |
| 5,450,049 | A * | 9/1995 | Bachmann | 335/205 |
| 6,018,130 | A * | 1/2000 | Haack et al. | 200/61.52 |

FOREIGN PATENT DOCUMENTS

| | | |
|---|---|---|
| JP | 1310053 | 9/2007 |
| JP | 1340020 | 9/2008 |
| JP | 2010014532 | 1/2010 |

* cited by examiner

*Primary Examiner* — Edwin A. Leon
(74) *Attorney, Agent, or Firm* — Adams & Wilks

(57) ABSTRACT

An acceleration switch includes a mass body having a space therein, a single arc-shaped beam supporting the mass body, a support portion supporting the arc-shaped beam, and a counter electrode disposed in the space of the mass body. The arc-shaped beam is arranged so as to surround the mass body, and the support portion is disposed at a periphery of the mass body. An electrode interval corresponding to a distance between an inner side surface of the mass body and an outer side surface of the counter electrode is 1 μm or more and 20 μm or less.

20 Claims, 12 Drawing Sheets

Beam width (μm)

| | Beam thickness (μm) | | | | | | | |
|---|---|---|---|---|---|---|---|---|
| | 4 | 5 | 20 | 40 | 100 | 200 | 350 | 500 |
| 70 | 1.2 | 0.9 | 0.2 | 0.1 | 0.0 | 0.0 | 0.0 | 0.0 |
| 60 | 1.9 | 1.5 | 0.4 | 0.2 | 0.2 | 0.0 | 0.0 | 0.0 |
| 40 | 6.3 | 5.0 | 1.3 | 0.6 | 0.3 | 0.1 | 0.1 | 0.1 |
| 20 | 50.1 | 40.1 | 10.0 | 5.0 | 2.0 | 1.0 | 0.6 | 0.4 |
| 15 | 118.4 | 94.7 | 23.7 | 11.8 | 4.7 | 2.4 | 1.4 | 0.9 |
| 10 | 397.9 | 318.3 | 79.6 | 39.8 | 15.9 | 8.0 | 4.5 | 3.2 |
| 7 | 1155.8 | 924.6 | 231.2 | 115.6 | 46.2 | 23.1 | 13.2 | 9.2 |
| 4 | 6159.8 | 4927.8 | 1232.0 | 616.0 | 246.4 | 123.2 | 70.4 | 49.3 |
| 3 | 14559.1 | 11647.3 | 2911.8 | 1455.9 | 582.4 | 291.2 | 166.4 | 116.4 |

Beam width (μm)

| | Beam thickness (μm) | | | | | | | |
|---|---|---|---|---|---|---|---|---|
| | 4 | 5 | 10 | 50 | 100 | 200 | 350 | 500 |
| 25 | 0.8 | 0.7 | 0.3 | 0.1 | 0.0 | 0.0 | 0.0 | 0.0 |
| 20 | 1.6 | 1.3 | 0.7 | 0.1 | 0.1 | 0.0 | 0.0 | 0.0 |
| 15 | 3.9 | 3.1 | 1.5 | 0.3 | 0.2 | 0.1 | 0.0 | 0.0 |
| 10 | 13.0 | 10.4 | 5.2 | 1.0 | 0.5 | 0.3 | 0.1 | 0.1 |
| 8 | 25.2 | 20.2 | 10.1 | 2.0 | 1.0 | 0.5 | 0.3 | 0.2 |
| 5 | 102.3 | 81.8 | 40.9 | 8.2 | 4.1 | 2.0 | 1.2 | 0.8 |
| 4 | 198.9 | 159.1 | 79.6 | 15.9 | 8.0 | 4.0 | 2.3 | 1.6 |
| 3 | 468.8 | 375.0 | 187.5 | 37.5 | 18.8 | 9.4 | 5.4 | 3.8 |

ACCELERATION SWITCH AND ELECTRONIC DEVICE

CROSS-REFERENCE TO RELATED APPLICATIONS

This application is a U.S. national stage application of International Application No. PCT/JP2011/054682 filed Mar. 2, 2011, claiming a priority date of Mar. 3, 2010, and published in a non-English language.

BACKGROUND OF THE INVENTION

1. Technical Field

The present invention relates to an acceleration switch and an electronic device including the acceleration switch.

2. Background Art

As a conventional acceleration switch, an omnidirectional acceleration switch in which a counter electrode is provided inside amass body and the mass body is supported by a plurality of beams is described with reference to FIG. 19. FIG. 19 is a top view of the conventional acceleration switch. This acceleration switch 100 includes a peripheral portion 101, four beams 102 to 105, a mass body (weight) 106, and a counter electrode 107. One end of the mass body is supported by the four beams, which are fixed to the peripheral portion. In accordance with acceleration applied to the acceleration switch, the mass body and the counter electrode disposed inside the mass body are brought into contact with each other. In this manner, an external device connected to the acceleration switch detects vibration. This acceleration switch has various advantages such as being available as a normally-off and omnidirectional switch and being relatively compact and mass-producible because monocrystalline silicon can be used as abase for production with the use of semiconductor manufacturing technology.

If the acceleration switch is mounted in, for example, a portable device which can incorporate only a small capacity battery to save power, the device can stop its operation when a human vibration is not detected, that is, when the device is not used, and the device can automatically start its operation upon detection of vibration, that is, when the device is used. Thus, it is possible to realize an electronic device in which the wasted use of a battery is avoided.

On the other hand, in an acceleration switch which detects vibration based on applied acceleration and turns ON and OFF the device, it is desired to uniformly detect vibration in any direction, and hence an omnidirectional switch is advantageous. Accordingly, as described in Patent Literature 1, it is desired to support a weight (mass body) by a plurality of beams so that the vibration of the weight may not be one-sided depending on the acceleration.

Such acceleration switch to be mounted on a portable device is highly required to be more compact, and hence a smaller external dimension of the acceleration switch is more advantageous. Cost of the acceleration switch is also highly required to be lower, and it is therefore further advantageous to use the semiconductor manufacturing technology to reduce the external dimension of the acceleration switch and thereby produce a large number of acceleration switches on a single wafer.

CITATION LIST

Patent Literature

Patent Literature 1: Japanese Design Registration No. 1310053

However, when the number of beams for supporting the weight is increased as in the conventional acceleration switch, the movement of the weight caused by acceleration, namely a displacement amount, becomes smaller, with the result that the sensitivity of the acceleration switch is lowered. The increased number of beams needs a larger area for disposing the beams, which is disadvantageous in downsizing the acceleration switch. When the acceleration switch is downsized, the size of the weight is also reduced, and hence, in order to ensure high sensitivity, it is necessary to form the beam into a more flexible shape so as to ensure a larger displacement amount of the weight.

On the other hand, the acceleration switch also needs to ensure impact resistance high enough to resist impact when falling, and the beam therefore needs to have such dimensions and shape that are resistant to external impact.

The acceleration switch also needs to operate reliably in response to a predetermined vibration to activate a device including the acceleration switch.

SUMMARY OF THE INVENTION

The present invention has been made in view of the above-mentioned circumstances, and it is an object thereof to realize a compact, high-sensitive acceleration switch which ensures impact resistance and operates reliably in response to a predetermined vibration, and an electronic device including the acceleration switch.

According to the present invention, there is provided an acceleration switch, including: a mass body having a space inside; an arc-like beam for supporting the mass body, the arc-like beam being adapted to warp by inertia force applied to the mass body when receiving acceleration and being disposed so as to surround the mass body; a support portion for supporting the arc-like beam, the support portion being disposed at a periphery of the mass body in a state of fixing the arc-like beam; and a counter electrode disposed in the space of the mass body, for detecting a contact with the mass body when receiving the acceleration, in which a number of the beams for supporting the mass body is one, and in which an electrode interval, which is a distance between an inner side surface of the mass body and an outer side surface of the counter electrode, is 1 μm or more and 20 μm or less.

According to the acceleration switch of the present invention, the electrode interval is formed under the conditions of being 1 μm or more and 20 μm or less to ensure the accuracy of the sensitivity necessary for the acceleration switch. Further, the number of beams is one, and hence, even when the acceleration switch is downsized, the region occupied by the beam is small as compared with a switch having a plurality of beams. Accordingly, the volume of the mass body can be ensured, and the length of the beam can also be ensured. Thus, an acceleration switch which ensures a large displacement amount of the mass body and which has sufficient sensitivity can be realized.

Further, in the above-mentioned acceleration switch, a thickness h of the arc-like beam and a width w of the arc-like beam are set based on the following expression:

$$\delta \propto \frac{1}{Ehw^3} \quad \text{[Math. 1]}$$

where δ represents a displacement amount of the mass body, E represents Young's modulus of a material, and the displacement amount δ satisfies a condition of being 1 μm or more and 20 μm or less corresponding to the electrode interval.

According to this acceleration switch, the displacement amount of the mass body can be set to a predetermined value through the change of the ratio of the beam thickness and the beam width. Thus, an acceleration switch which operates reliably in response to a predetermined vibration can be realized.

Further, in the above-mentioned acceleration switch, a width w of the arc-like beam and a thickness h of the arc-like beam are set based on the following expression:

$$\delta \propto \sigma(r_1^2 - r_2^2)H \cdot a \cdot \frac{R^3}{Ehw^3} \cdot (1 - \nu^2) \quad \text{[Math. 2]}$$

where δ represents a displacement amount of the mass body, σ represents a density of a material of the mass body, R represents a radius of the arc-like beam, $r_1$ represents an outer radius of the mass body, $r_2$ represents a radius of the space inside the mass body, H represents a thickness of the mass body, a represents the acceleration to be applied, E represents Young's modulus of a material of the arc-like beam, ν represents a Poisson's ratio of the material of the arc-like beam, and the displacement amount δ satisfies a condition of being 1 μm or more and 20 μm or less corresponding to the electrode interval.

According to this acceleration switch, even when the acceleration switch is downsized, the width w of the beam and the thickness h of the beam can be set to optimum conditions while ensuring the space of the mass body as much as possible. Thus, an acceleration switch which has impact resistance and operates reliably in response to a predetermined vibration can be realized.

Further, in the above-mentioned acceleration switch, the arc-like beam has a width of 4 μm or more and 60 μm or less.

According to this acceleration switch, even when the acceleration switch is downsized, an acceleration switch which ensures the accuracy of the beam width and ensures the space of the mass body as much as possible and which operates reliably in response to a predetermined vibration can be realized.

Further, in the above-mentioned acceleration switch, the arc-like beam has a thickness of 5 μm or more and 500 μm or less, which is equal to or smaller than a thickness of the mass body.

According to this acceleration switch, an acceleration switch which ensures impact resistance necessary to resist impact applied to the beam when falling and which operates reliably in response to a predetermined vibration even when the acceleration switch is downsized can be realized.

Further, an external dimension of an acceleration switch main portion including the support portion, the mass body, the arc-like beam, and the counter electrode is 0.5 mm or more and 3 mm or less.

According to this acceleration switch in which the external dimension of the acceleration switch main portion including the support portion, the mass body, the beam, and the counter electrode is 0.5 mm or more and 3 mm or less, the degree of freedom in setting the beam width and the beam thickness is high, and hence, even when the acceleration switch is downsized, it is possible to set a wider range of the sensitivity of the acceleration switch.

Further, an external dimension of an acceleration switch main portion including the support portion, the mass body, the arc-like beam, and the counter electrode is 0.5 mm or more and 1.5 mm or less, the arc-like beam has a width of 4 μm or more and 20 μm or less, and the arc-like beam has a thickness of 5 μm or more and 500 μm or less, which is equal to or smaller than a thickness of the mass body.

This acceleration switch in which the external dimension of the acceleration switch main portion including the support portion, the mass body, the beam, and the counter electrode is 0.5 mm or more and 1.5 mm or less is more compact than the acceleration switch having an external dimension of about 2 mm. Thus, it is possible to suppress production cost per acceleration switch. Further, the space for mounting the acceleration switch can be made smaller, and hence this acceleration switch can be mounted in a more compact electronic device.

Further, in the above-mentioned acceleration switch, (1) a distance between one end of the arc-like beam on the mass body side and another end of the arc-like beam on the support portion side is larger than a maximum distance between the counter electrode and an inner surface of the mass body, (2) a distance between the mass body and the another end of the arc-like beam on the support portion side is larger than the maximum distance between the counter electrode and the inner surface of the mass body, and (3) a distance between the one end of the arc-like beam on the mass body side and the support portion is larger than the maximum distance between the counter electrode and the inner surface of the mass body.

According to the acceleration switch of the present invention, (1) the interval between the one end of the beam on the mass body side and the other end of the beam on the support portion side, (2) the interval between the mass body and the other end of the beam on the support portion side, and (3) the interval between the one end of the beam on the mass body side and the support portion are larger than the interval between an inner side surface of the mass body and a side surface of the counter electrode, namely an electrode interval. Thus, it is possible to avoid a phenomenon that the mass body and the beam, the support portion and the beam, or parts of the beam are brought into contact with each other before the weight and the counter electrode are brought into contact with each other. Therefore, even when vibration of a certain level or more is applied in the horizontal direction, it is possible to detect the vibration by the acceleration switch reliably.

Further, in the above-mentioned acceleration switch, the acceleration switch has a configuration in which a first substrate, a second substrate including the mass body, the counter electrode, the arc-like beam, and the support portion, and a third substrate are laminated, the first substrate has a contact to be connected to an external circuit, and includes a first through electrode and a second through electrode which serve as contacts to be connected to the support portion or the counter electrode, and the first substrate and the third substrate are bonded to the support portion and the counter electrode which are included in the second substrate.

According to this acceleration switch, the first substrate and the third substrate are bonded so as to sandwich the second substrate, and hence the mass body, the beam, and the counter electrode can be protected from external environments. Further, connection to an external electronic device can be ensured via the first and second through electrodes that pass through the first substrate, and hence it is possible to easily realize the mounting of the acceleration switch and the electrical connection to the electronic device for detecting vibration via the substrate on which the acceleration switch is mounted.

Further, in the above-mentioned acceleration switch, the counter electrode includes a plurality of electrode portions.

According to this acceleration switch, the presence or absence of contacts between the plurality of electrode portions and the mass body is detected by the external circuit, and hence not only vibration of a certain level or more but also a direction of the applied acceleration can be detected. Therefore, it is possible to detect a movement direction of the acceleration switch and a tilt direction with respect to the acceleration switch.

Further, according to the present invention, there is provided an electronic device, including: the above-mentioned acceleration switch; and a circuit for detecting a detection signal output from the acceleration switch to perform a predetermined operation in accordance with the detection signal.

According to this electronic device, the compact, high-sensitive, normally-off acceleration switch is mounted, and hence the electronic device can be controlled so as to stop when no vibration is detected, that is, when the device is not used, and so as to automatically operate when vibration is detected, that is, only when the device is used. Therefore, it is possible to realize the downsizing and the reduction in power consumption of the electronic device at low cost.

Advantageous Effects of Invention

According to the present invention, the compact, high-sensitive acceleration switch which ensures necessary impact resistance and operates reliably in response to a predetermined vibration and the electronic device including the acceleration switch can be realized.

DETAILED DESCRIPTION OF THE INVENTION

Configuration and Operation of Acceleration Switch

Hereinafter, embodiments of the present invention are described with reference to the accompanying drawings.

Figure 1:
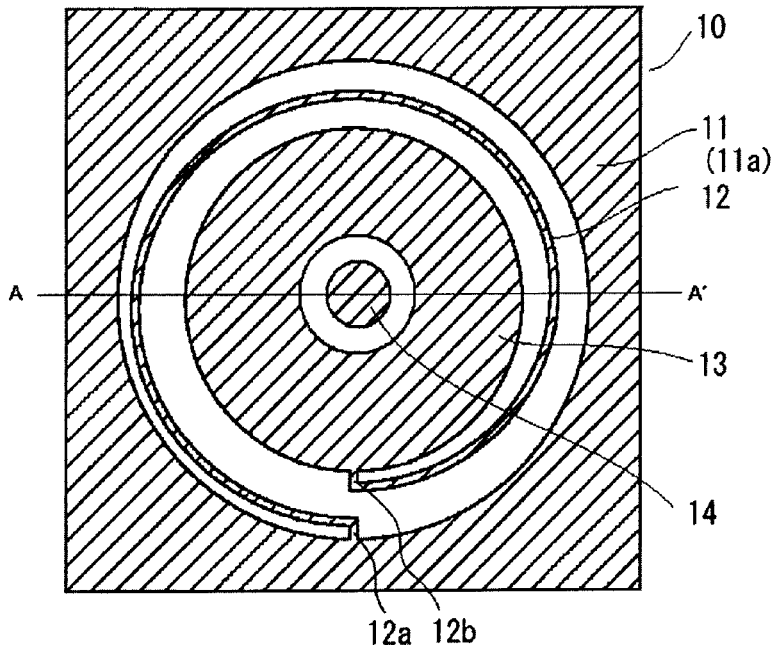
FIG. 1 is a cross-sectional view illustrating a configuration of an acceleration switch according to the present invention.
Figure 2:
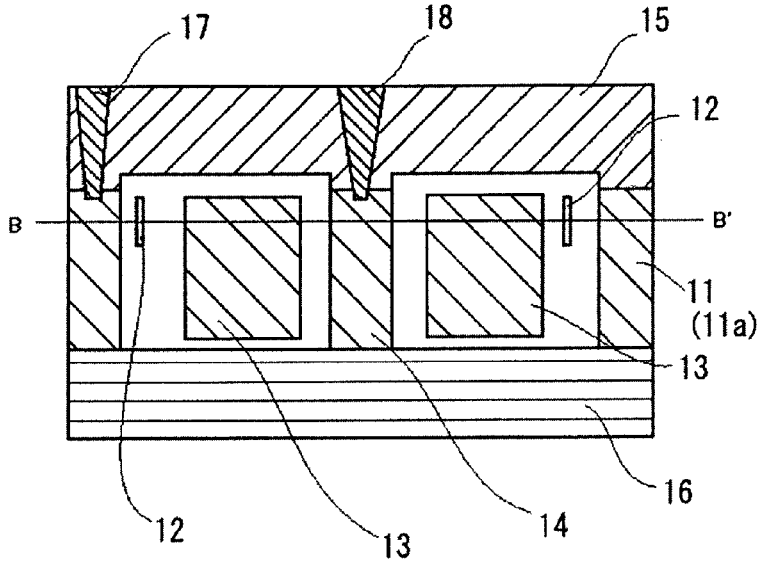
FIG. 2 is a vertical cross-sectional view of the acceleration switch taken along the plane A-A' of FIG. 1.
Figure 3:
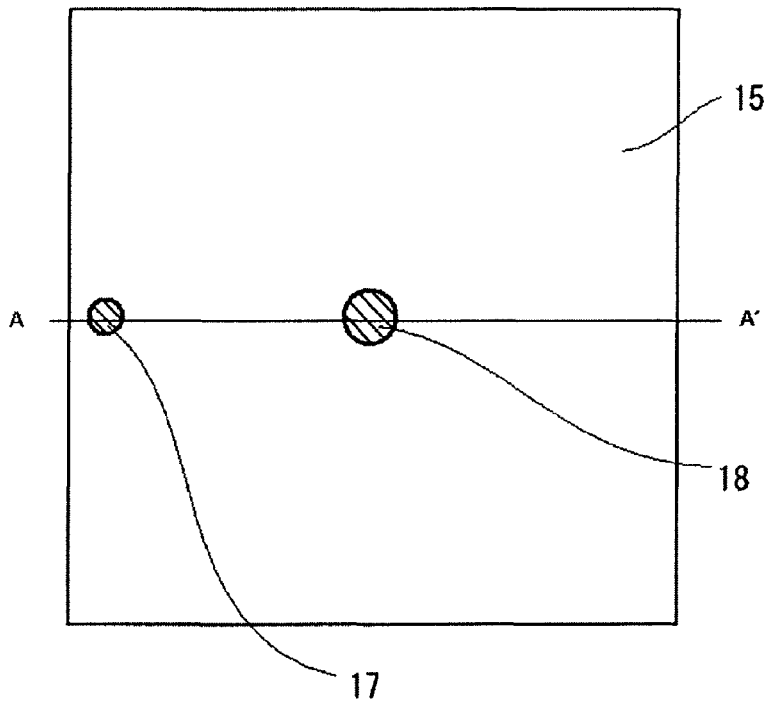
FIG. 3 is a top view of a cap layer (first substrate) of the acceleration switch according to the present invention.

FIG. 1 is a cross-sectional view of an acceleration switch 10 according to the present invention. It is noted that a first substrate serving as a cap layer is present on the cross-section and a third substrate serving as a support layer is present thereunder. FIG. 2 is a vertical cross-sectional view taken along the plane A-A' illustrated in FIG. 1, which includes the cap layer and the support layer. FIG. 1 corresponds to the cross-section taken along the plane B-B' of FIG. 2. FIG. 3 is a top view of the cap layer provided at the top, which is omitted in FIG. 1. FIG. 2 is also a vertical cross-sectional view taken along the plane A-A' of FIG. 3 similarly to FIG. 1.

As illustrated in FIGS. 1 to 3, the acceleration switch 10 is formed by laminating, from the top, a first substrate 15 using an insulating material such as glass, a second substrate 11 using monocrystalline silicon or the like, and a third substrate 16 using an insulating material such as glass. In the second substrate 11, a support portion 11*a*, a beam 12, a weight (mass body) 13, and a counter electrode 14 are formed by silicon etching. One end of the beam 12 is fixed to the support portion 11*a* disposed at the periphery of the second substrate 11, and the other end is fixed to the weight 13. The one end of the beam 12 on the support portion 11*a* side is referred to as a connection portion 12*a*, and the other end of the beam on the weight 13 side is referred to as a connection portion 12*b*. The weight 13 has a space formed inside, and is disposed on the inner side of the beam 12 and supported by the beam. The counter electrode 14 is disposed in the space formed inside the weight 13. When vibration of a certain level or more is applied to the acceleration switch 10 in the horizontal direction, the counter electrode 14 is brought into contact with the weight to regulate the movement of the weight within a predetermined range. As the monocrystalline silicon of the second substrate 11, low-resistivity silicon or the like is used in order to establish electrical conduction from the beam 12 to the counter electrode 14 via the weight 13. Through electrodes 17 and 18 are each formed by embedding a conductor such as a metal into the first substrate 15 so as to pass through the first substrate 15. One ends of the through electrodes 17 and 18 are electrically connected to the support portion 11*a* supporting the beam 12 and to the counter electrode 14, respectively, and the other ends are electrically connected to an external circuit. The first substrate 15 and the third substrate 16 are bonded to the second substrate 11 by anodic bonding or other methods.

Figure 4:
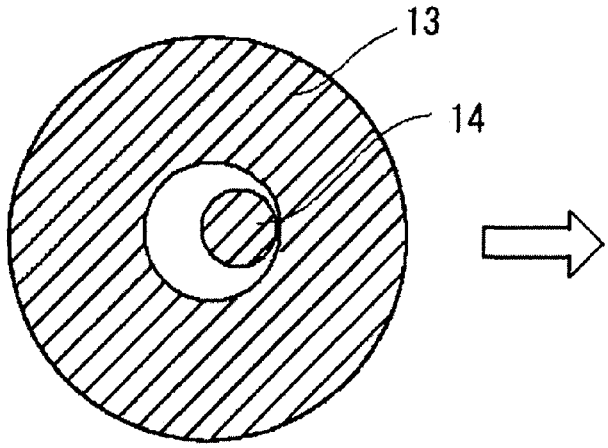
FIG. 4 is an explanatory diagram illustrating an operation of the acceleration switch according to the present invention.

Next, the operation of the acceleration switch according to the present invention is described with reference to an explanatory diagram of FIG. 4. For easier understanding of the movement of the weight 13, FIG. 4 omits the beam at the periphery of the weight and a peripheral portion around the beam.

First, when acceleration is applied to the acceleration switch in the arrow direction, the overall acceleration switch except for the weight moves in the arrow direction. The weight supported by the beam, on the other hand, does not move because the acceleration is not directly applied to the weight. Accordingly, the counter electrode 14 disposed in the space inside the weight is brought into contact with the weight 13. In this manner, electrical conduction is ensured between the weight 13 and the counter electrode 14. The beam 12, the support portion 11*a*, and the through electrode 17 are electrically connected to each other all the time as illustrated in FIGS. 1 and 2, and hence, only when an acceleration having a certain value or more is applied to the acceleration switch 10, the weight 13 and the counter electrode 14 are brought into contact with each other so that the through electrode 17 and the through electrode 18 are electrically connected to each other.

In the acceleration switch 10 in which the weight 13 illustrated in FIG. 1 is supported by a single beam and the beam 12 is formed so as to substantially surround the circumference of the weight, if the beam 12 is formed in a gap between the weight and the support portion 11*a* to be as long as possible for the purpose of ensuring a displacement amount of the weight, the connection portion 12*a* between the beam and the support portion and the connection portion 12*b* between the beam and the weight are inevitably made close to each other. On the other hand, if the connection portion 12*a* and the connection portion 12*b* are too close to each other, the connection portion 12*a* and the connection portion 12*b* are brought into contact with each other before the weight 13 and the counter electrode 14 are brought into contact with each other, leading to a phenomenon that, even when vibration of a certain level or more is applied in the horizontal direction, the vibration is not detected by the acceleration switch. As a countermeasure, in the acceleration switch according to the present invention, the interval (distance) between the one end 12*a* of the beam for the support portion and the other end for the weight (mass body) is ensured to be longer than the interval (distance) between the inner surface of the weight and the counter electrode 14. In this manner, the weight and the counter electrode are brought into contact with each other reliably in response to vibration of a certain level or more.

Also in the case where the gap between the connection portion 12*a* of the beam 12 for the support portion and the weight 13 is too narrow, the connection portion 12*a* and the weight 13 are brought into contact with each other before the weight and the counter electrode are brought into contact with each other, leading to a phenomenon that, even when vibration of a certain level or more is applied in the horizontal direction, the vibration cannot be detected by the acceleration switch. As a countermeasure, in the acceleration switch according to the present invention, the interval (distance) between the one end of the beam on the support portion side and the outer side surface of the beam weight is ensured to be longer than the interval between the inner surface of the weight (mass body) and the counter electrode. In this manner, the weight and the counter electrode are brought into contact with each other reliably in response to vibration of a predetermined level or more.

In addition, also in the case where the gap between the connection portion 12*b* of the beam 12 for the weight 13 and the inner side surface of the support portion 11*a* is too narrow, the connection portion 12*b* and the support portion 11*a* are brought into contact with each other before the weight 13 and the counter electrode 14 are brought into contact with each other, leading to a phenomenon that, even when vibration of a predetermined level or more is applied in the horizontal direction, the vibration cannot be detected by the acceleration switch. As a countermeasure, in the acceleration switch according to the present invention, the distance between the one end of the beam on the support portion side and the other end of the beam on the weight (mass body) side is ensured to be longer than the interval between the inner surface of the weight and the counter electrode. In this manner, the weight and the counter electrode are brought into contact with each other reliably in response to vibration of a predetermined level or more.

Next, as another embodiment of the present invention, description is given of an electronic device which is capable of detecting vibration by using the acceleration switch according to the present invention as a switch for activating the electronic device. This electronic device is connected to the above-mentioned acceleration switch, and detects a change in ON/OFF state of the acceleration switch via the through electrodes 17 and 18 of the acceleration switch as a detection signal. In this manner, the electronic device performs a predetermined operation. That is, the electronic device activates by itself when detecting vibration, but, when not detecting vibration, the electronic device stops (OFF) or keeps the suspension state, or makes a transition from the activated (ON) state to the stop or suspension state. In this manner, the wasteful use of a battery is restricted, and hence the downsizing and the reduction in power consumption of the electronic device can be realized at low cost.

[Sensitive Isotropy of Acceleration Switch having Single Beam—First Simulation]

In the acceleration switch in which the space is formed at the center of the weight and the counter electrode is provided inside the space, if the weight is supported by a plurality of beams, a deviation becomes smaller. Therefore, in order to obtain uniform sensitivity in the planar direction, this configuration is suitable for an omnidirectional acceleration switch.

In this case, however, the number of beams is large, and hence the displacement amount of the weight is reduced to lower the sensitivity. Then, an examination is made on the deviation in displacement amount of the weight in the planar direction of the acceleration switch in which the weight is supported by a single beam, thereby making a study on the availability of the acceleration switch having a single beam. If no deviation occurs in the displacement amount even when the weight is supported by a single beam, the sensitivity is basically high and the space occupied by the beam is small as compared with the case of supporting the weight by two or more beams. This configuration is therefore advantageous in realizing a compact acceleration switch.

Figure 5:
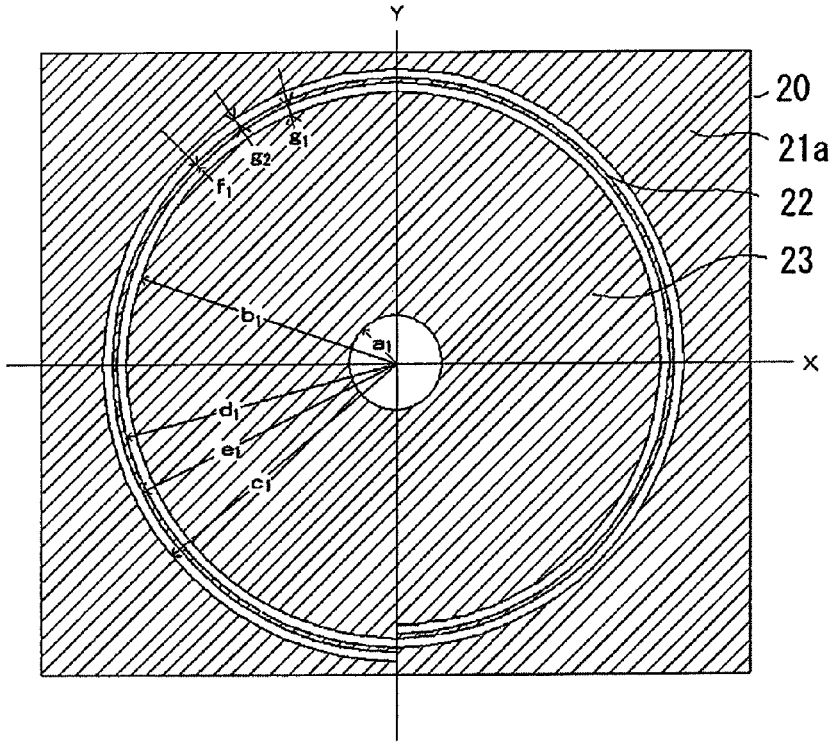
FIG. 5 is a top view of an acceleration switch subjected to a first simulation.
Figure 6:
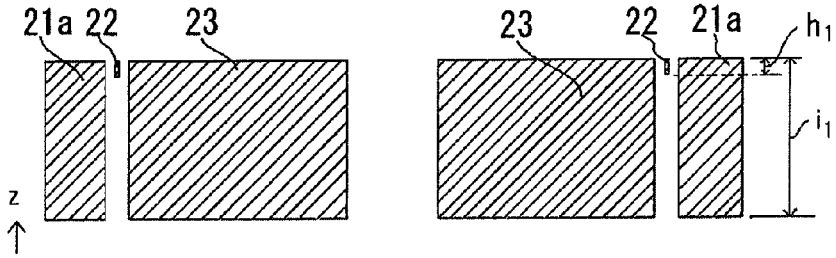
FIG. 6 is a vertical cross-sectional view on the X-axis of the acceleration switch of FIG. 5.
Figure 7:
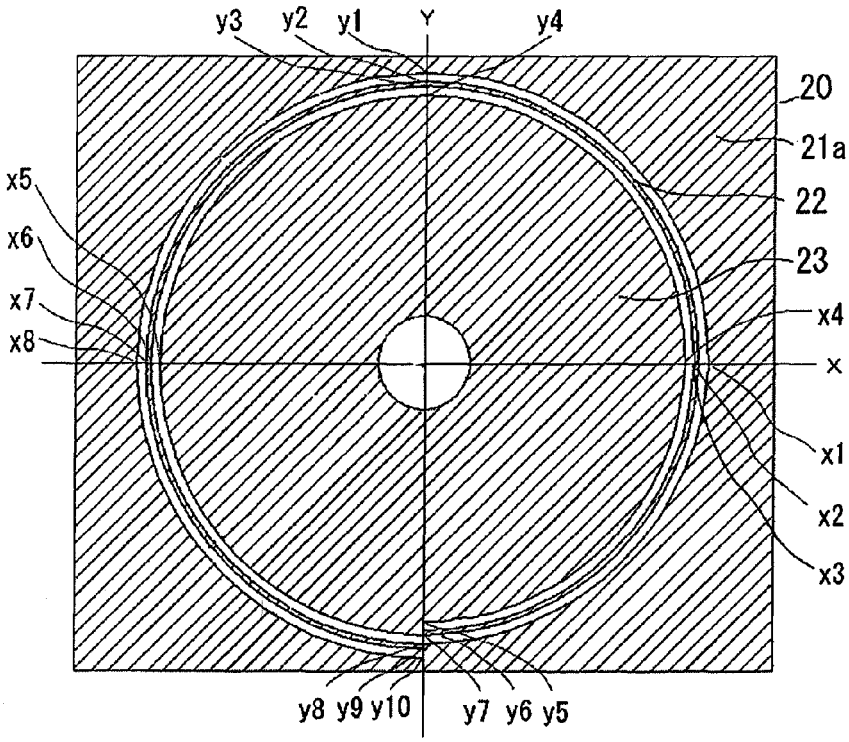
FIG. 7 is a view illustrating intersections between the X-axis and Y-axis and A structure of the acceleration switch of FIG. 5.

In view of the above, a first simulation is performed based on a model of the acceleration switch illustrated in FIGS. 5 to 7, to examine the sensitive isotropy of the acceleration switch having a single beam. Specifically, with the use of monocrystalline silicon as the material of the structure, the first simulation of calculating a displacement amount of the weight is performed under the conditions of applying an acceleration of 1 G in the −Z axis direction corresponding to the gravity and in the X-Y planar direction corresponding to vibration to be applied, to thereby examine the presence or absence of fluctuations in displacement amount of the acceleration switch in which the weight is supported by a single beam, namely the sensitive isotropy. This corresponds to the state where the acceleration switch is placed horizontally and the acceleration is applied in the planar direction.

First, the shape and conditions of the acceleration switch subjected to the first simulation are set as follows. FIG. 5 illustrates a model of an acceleration switch 20 used in the first simulation. FIG. 5 is a top view of the acceleration switch 20, and the model was produced on the X-Y plane, with the intersection of the X axis and the Y axis being (0, 0). FIG. 6 is a vertical cross-sectional view on the X axis of FIG. 5. This simulation paid attention to a displacement amount of a weight 23, and hence FIGS. 5 and 6 omit the counter electrode disposed on the inner side of the weight. FIG. 5 models only a structural portion including a movable portion necessary for the simulation, not the overall acceleration switch as in the acceleration switch illustrated in FIGS. 1 to 3. In the first simulation, a maximum displacement amount of the weight 23 is calculated under two kinds of conditions where the beam thickness is 20 μm and 40 μm. The calculation of this simulation is performed using a Coventor.

In the acceleration switch illustrated in FIGS. 5 and 6, the outer edge of the weight 23 has a shape in which two semi-arcs are combined. The left half of the arc on the outer side of the weight is modeled under the following condition regarding the outer radius (b1) of the weight. The right half of the arc on the outer side of the weight is modeled based on coordinates illustrated in FIG. 7 as an arc connecting to the end of the arc on the left half. Note that, the space inside the weight is a laterally-symmetric, true circle, and is modeled under a condition regarding the inner radius (a1) of the weight. An inner diameter (c1) of the support portion 21*a* corresponding to an outer frame of the arc on the left half, an inner radius (d1) of the beam, and an outer radius (e1) of the beam are modeled under the following conditions. A beam width (f1), an interval (g1) between the beam and the outer side of the weight, an interval (g2) between the beam and the support portion, a beam thickness (h1), and a weight thickness (i1) are modeled under the following conditions. The thickness of the structure including the weight thickness (i1) is laterally uniform.

Conditions of first simulation model (unit: μm)
Inner radius of weight (a1): 100
Outer radius of weight (b1): 585
Inner diameter of outer frame (c1): 635
Inner radius of beam (d1): 605
Outer radius of beam (e1): 615
Beam width (f1): 10
Interval between beam and outer side of weight (g1): 20
Interval between beam and support portion (g2): 20
Beam thickness (h1): 20 and 40
Weight thickness (i1): 350

For representing the conditions of the arcs, the coordinates of the intersections of the left and right outer edges of the weight, the beam, the inner edge of the support portion corresponding to the outer frame with respect to the X axis and the Y axis are shown as follows. The following are the respective coordinates of the intersections of the left and right outer edges of the weight, the beam, and the inner edge of the outer frame illustrated in FIG. 7 with respect to the X axis and the Y axis. (unit: μm)

Intersections with respect to X axis
x1: (635, 0)
x2: (615, 0)
x3: (605, 0)
x4: (585, 0)
x5: (−570, 0)
x6: (−590, 0)
x7: (−600, 0)
x8: (−620, 0)
Intersections with respect to Y axis
y1: (0, 635)
y2: (0, 615)
y3: (0, 605)
y4: (0, 585)
y5: (0, 575)
y6: (0, 555)
y7: (0, −585)
y8: (0, −605)
y9: (0, −615)
y10: (0, −635)

The following are physical properties of the monocrystalline silicon as the material of the first substrate used in the first simulation.

Young's modulus E: 165 GPa
Poisson's ratio ν: 0.30
Density σ: 2,500 Kg/m$^3$

The following are calculation results of the first simulation of applying an acceleration of 1 G to the acceleration switch in the Z axis direction corresponding to the gravity and in the X axis direction corresponding to vibration based on the shape of the acceleration switch illustrated in FIGS. 5 to 7.

(1a) Displacement amount of weight in case of beam thickness of 20 μm
Maximum value in X direction: 23.67 μm
Maximum value in Y direction: 3.42 μm
(1b) Displacement amount of weight in case of beam thickness of 40 μm
Maximum value in X direction: 12.17 μm
Maximum value in Y direction: 1.87 μm Similarly, the following are results of the first simulation of applying an acceleration of 1 G to the shape of FIG. 5 in the Z axis direction and in the Y axis direction.

(2a) Displacement amount of weight in case of beam thickness of 20 μm
Maximum value in Y direction: 23.70 μm
Maximum value in X direction: 0.65 μm
(2b) Displacement amount of weight in case of beam thickness of 40 μm
Maximum value in Y direction: 12.09 μm
Maximum value in X direction: 0.34 μm From the results of the first simulation, the following three characteristics were obtained.

(1) In-axis sensitivity for X and Y axes: a maximum displacement amount in the X axis direction when the acceleration is applied in the X axis direction and a maximum displacement amount in the Y axis direction when the acceleration is applied in the Y axis direction are different from each other by about 0.12%, and hence substantially the same displacement amount is developed in the X and Y directions.

(2) Cross-axis sensitivity for X axis: when the acceleration is applied in the X axis direction, the amount of displacement in the Y direction as an inclination (cross-axis displacement amount) is about 14% of the maximum displacement amount in the X direction (in the case of the beam thickness of 20 μm) and about 15% (in the case of the beam thickness of 40 μm).

(3) Cross-axis sensitivity for Y axis: when the acceleration is applied in the Y axis direction, the amount of displacement in the X direction as an inclination (cross-axis displacement amount) is about 2.7% of the maximum displacement amount in the Y direction (in the case of the beam thickness of 20 μm) and about 2.8% (in the case of the beam thickness of 40 μm).

It is obvious from the characteristics (1) to (3) obtained from the first simulation that, even when the acceleration switch has a configuration in which the weight is supported by a single arc-like beam, the in-axis sensitivities in the X direction and the Y direction, which are the sensitivities in acceleration-applied directions, are substantially the same, and the cross-axis sensitivity which is the sensitivity in the in-plane direction perpendicular to the acceleration-applied direction is much smaller than the in-axis sensitivity which is the sensitivity in the acceleration-applied direction. Therefore, for example, in the application where the movement of a human is detected by vibration to turn ON/OFF a portable device, a sufficiently isotropic sensitivity is obtained, and there is no phenomenon that the sensitivity becomes lower depending on the direction of applied acceleration or the sensitivity becomes higher in the in-plane direction perpendicular to the applied direction. It is therefore obvious that a sufficiently isotropic sensitivity can be ensured even by the configuration of the acceleration switch in which the weight is supported by a single beam. Note that, in the acceleration switch illustrated in FIG. 5, the beam for supporting the weight is configured such that a single beam is wound once, but it is obvious that the isotropic sensitivity can be obtained even in an acceleration switch in which the beam for supporting the weight is wound multiple times, such as twice or three times. Further, it is also possible to configure the beam to be wound less than once as long as the isotropic sensitivity is not impaired.

[Conditions of Beam of Acceleration Switch—Second Simulation]

In this second simulation, analysis is made on optimum conditions of the beam in the acceleration switch having a single beam. Specifically, based on a second simulation model, respective conditions of an acceleration switch having an external dimension of 2 mm (square) are set, and various conditions of the beam width and the beam thickness are varied to obtain displacement amounts of the weight under various conditions. In this manner, analysis is made on the optimum conditions of the beam to define the optimum conditions of the beam of the acceleration switch.

Figure 8:
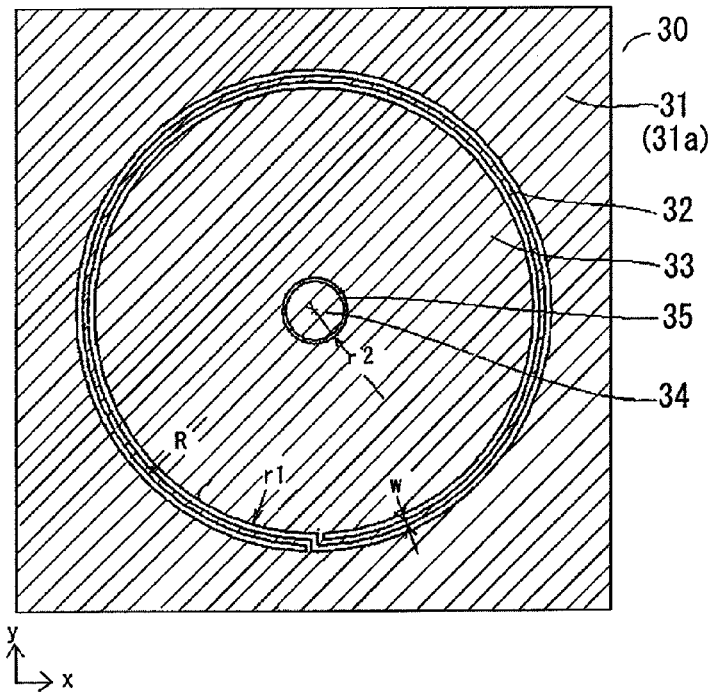
FIG. 8 is a top view of an acceleration switch subjected to second and third simulations.
Figure 9:
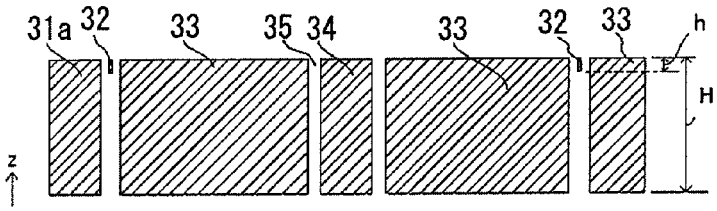
FIG. 9 is a vertical cross-sectional view of the acceleration switch subjected to the second and third simulations.

First, the respective conditions regarding an acceleration switch 30 subjected to the second simulation are described with reference to FIGS. 8 and 9. FIG. 8 is a top view of the acceleration switch 30 which is the second simulation model. FIG. 9 is a vertical cross-sectional view of the acceleration switch of FIG. 9. The acceleration switch 30 includes a support portion 31*a*, a beam 32, a weight (mass body) 33, and a counter electrode 34 which are formed by subjecting a silicon substrate to etching treatment. An electrode interval between the inner side surface of the weight 33 and the outer side surface of the counter electrode 34 is represented by 35. The weight 33 is manufactured easily if the thickness of the silicon substrate is directly used as the thickness of the weight. As the silicon substrate itself becomes thicker, the displacement amount of the weight becomes larger, which can enhance the sensitivity of the acceleration switch. When the thickness of the silicon substrate is increased, on the other hand, there is a problem in that an etching treatment time for forming each portion of the acceleration switch becomes longer due to a constraint on dry etching treatment. For etching of the silicon substrate, the Bosch process, being a type of dry etching, can be applied so that etching treatment is ended in a short period of time even in the case of a thick silicon substrate. However, if the silicon substrate is too thick, even when the Bosch process is applied, it takes much time for silicon etching treatment, resulting in increased manufacturing cost and difficulty in controlling the dimensions and shape of the weight because of the limited aspect ratio available to etching. It is therefore desired that the thickness of the silicon substrate be 500 μm or less. In this simulation, the thickness of the silicon substrate is set to 350 μm.

The support portion 31*a* of the acceleration switch is also a region for bonding necessary when used in anodic bonding or the like. Regarding the condition of this region, in the case of an acceleration switch having an external dimension of 2 mm, it is necessary to ensure a region of a bonding margin of about 20%, that is, about 200 μm on each side and a total of about 400 μm on both sides of a chip. Therefore, a diameter dimension including the circumference of the weight and the beam disposed at the periphery of the weight is about 1,600 μm. When the beam width is set to about 5 to 10 μm, the outer dimension of the weight is about 1,550 μm because it is necessary to ensure a gap between the beam and the weight and a gap between the beam and the support portion. In this simulation, the diameter dimension of the weight is set to 1,550 μm.

It is noted that this acceleration switch is assumed to be used in an application for saving power in connection with a portable device wearable by a human. Accordingly, by such a device, it is assumed that a system is turned ON when acceleration or vibration caused by the movement of the human is detected, and the use of the device is stopped when no vibration is detected, that is, when the human stands still or is at rest. The necessary sensitivity is therefore an acceleration of about 1 G or 1 G or less. This simulation calculates the conditions of the shape of the beam necessary when an acceleration of 1 G is applied to the acceleration switch. Another possible usage of the acceleration switch is the case where the acceleration switch is not placed horizontally but placed upright. In this case, a switch having a sensitivity of 2 G is necessary for obtaining a sensitivity of 1 G because the gravity of 1 G is applied in the vertical direction as an offset.

Next, the sensitivity and the electrode interval of the acceleration switch subjected to the second simulation are described. The sensitivity of the acceleration switch is proportional to the displacement amount of the weight, and is inversely proportional to the electrode interval which is the distance between the inner side surface of the weight and the side surface of the counter electrode. If the displacement amount of the weight is 10 μm when an acceleration of 1 G is applied to the acceleration switch, by setting the electrode interval to 10 μm, the counter electrode and the weight are brought into contact and electrically connected to each other, and finally, an electronic device connected to the acceleration switch detects the electrical connection as a detection signal. This acceleration switch having an electrode interval of 10 μm is an acceleration switch having a sensitivity of 1 G. If the electrode interval is set to 5 μm, the switch is turned ON with a half displacement amount of the weight, namely a half acceleration of 0.5 G. That is, this acceleration switch having an electrode interval of 5 μm is an acceleration switch having a sensitivity of 0.5 G. As described above, the electrode interval is an important factor in determining the sensitivity. The electrode interval is set depending on a possible applied acceleration when the acceleration switch is designed. For example, when the electrode interval is set shorter, the sensitivity of the acceleration switch can be enhanced.

However, the electrode interval has manufacturing constraints. If the Bosch process is applied as a silicon etching process for forming a gap between electrodes of the acceleration switch, etching needs to be performed more accurately because the sensitivity greatly changes depending on the accuracy of the electrode interval. In the case of forming a narrower electrode interval, a phenomenon of side etching or scalloping affects the dimension accuracy of the electrode interval, thus affecting the sensitivity. Therefore, taking the manufacturing reproducibility and accuracy of the acceleration switch into account, a realistic minimum value of the electrode interval is about 1 μm. On contrary, when the electrode interval is formed wider, in order that the weight be brought into contact first with the counter electrode reliably, it is necessary to ensure wider intervals between the weight and the beam and between the beam and the support portion. Due to such large intervals, the external dimension cannot be reduced, which is disadvantageous in cost. Therefore, in a compact acceleration switch, a realistic maximum value of the electrode interval is 20 μm.

The dimension of the beam also has manufacturing constraints, and is subjected to a constraint of a silicon etching process similarly to the electrode interval. In the case of using the Bosch process similarly to the production conditions of the gap corresponding to the above-mentioned electrode interval, it is possible to set the beam width to about 1 μm under the condition where the thickness of the silicon substrate is 350 μm. Regarding the beam, however, a realistic minimum value of the beam width is about 4 μm due to the constraints on the manufacturing reproducibility, accuracy, and the like.

Figure 10:
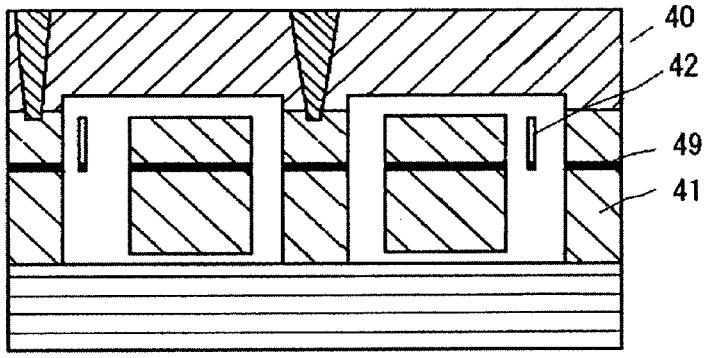
FIG. 10 is an explanatory diagram illustrating a cross-sectional structure of an acceleration switch using a SOI wafer as a second substrate.

Regarding the beam thickness, as illustrated in an explanatory diagram of an acceleration switch 40 of FIG. 10, if a SOI wafer including a SOI layer 49 is used as a second substrate 41, a beam 42 can be produced by using the thickness of this active layer directly as the thickness of the beam 42. Therefore, the constraint on the producible dimension due to the manufacturing reproducibility, accuracy, and the like is reduced, and a certain dimension accuracy can be ensured. However, taking the impact resistance assuming the falling of the acceleration switch into account, it is necessary to avoid producing an extremely thin beam, and hence a realistic minimum value of the beam thickness is about 5 μm.

Next, the second simulation based on the following conditions, which assumes the acceleration switch with an external dimension of 2 mm having the structure illustrated in the top view of FIG. 8 and the vertical cross-sectional view of FIG. 9, is performed to thereby analyze optimum conditions of the beam. Note that, the displacement amount of the weight is a displacement amount δ in the x direction measured when an acceleration of 1 G is applied to the acceleration switch in the x direction, and is calculated based on Expression (1) below. Regarding the conditions of Expression (1), the conditions of the properties of silicon as the materials of the beam and the weight are set based on the conditions of the first simulation, and other conditions are set based on respective conditions of the weight, the beam shape, the electrode interval, and the like of the above-mentioned acceleration switch of 2 mm.

Respective conditions of acceleration switch with external dimension of 2 mm (unit: μm)

Inner radius of weight ($r_1$): 155
Outer radius of weight ($r_2$): 760
Beam width (w): variable
Electrode interval (35): unlimited
Beam thickness (h): variable
Weight thickness (H): 350

Using the conditions of the acceleration switch having an external dimension of 2 mm, the second simulation based on Expression (1) below was performed under various conditions, to thereby determine the conditions of the beam width w and the beam thickness h satisfying a displacement amount of the weight effective as an acceleration switch. Results of the second simulation are shown in a graph of FIG. 11 and a table of FIG. 12.

In Expression (1) below, δ represents the displacement amount of the weight, σ represents the density of the material of the weight, π represents the circular constant, $r_1$ represents the outer radius of the weight, $r_2$ represents the radius of the space inside the weight, H represents the thickness of the weight, a represents the acceleration to be applied, R represents the radius of the beam, E represents Young's modulus of the material of the beam, and ν represents the Poisson's ratio of the material of the beam. Note that, an actual displacement amount of the weight includes the influence of actual fluctuations in Young's modulus of the material of the second substrate, and hence Expression (1) of the displacement amount δ is regarded as an approximation formula, and Expression (2) of the displacement amount δ excluding the constants which are not varied depending on the material of the second substrate and the shapes of the weight and the beam is regarded as a proportional formula.

[Math. 3]

$$\delta \approx 32\sigma\pi^2(r_1^2 - r_2^2)H \cdot a \cdot \frac{R^3}{Ehw^3} \cdot (1 - \nu^2) \tag{1}$$

[Math. 2]

$$\delta \propto \sigma(r_1^2 - r_2^2)H \cdot a \cdot \frac{R^3}{Ehw^3} \cdot (1 - \nu^2) \tag{2}$$

Note that, in the case where the beam width and the beam thickness are adjusted to set the displacement amount of the weight in accordance with the electrode interval, regarding the displacement amount δ, the beam thickness h, and the beam width w, a proportional formula of Expression (3) obtained by further simplifying Expression (2) is established.

[Math. 1]

$$\delta \propto \frac{1}{Ehw^3} \tag{3}$$

Figures 11, 12:
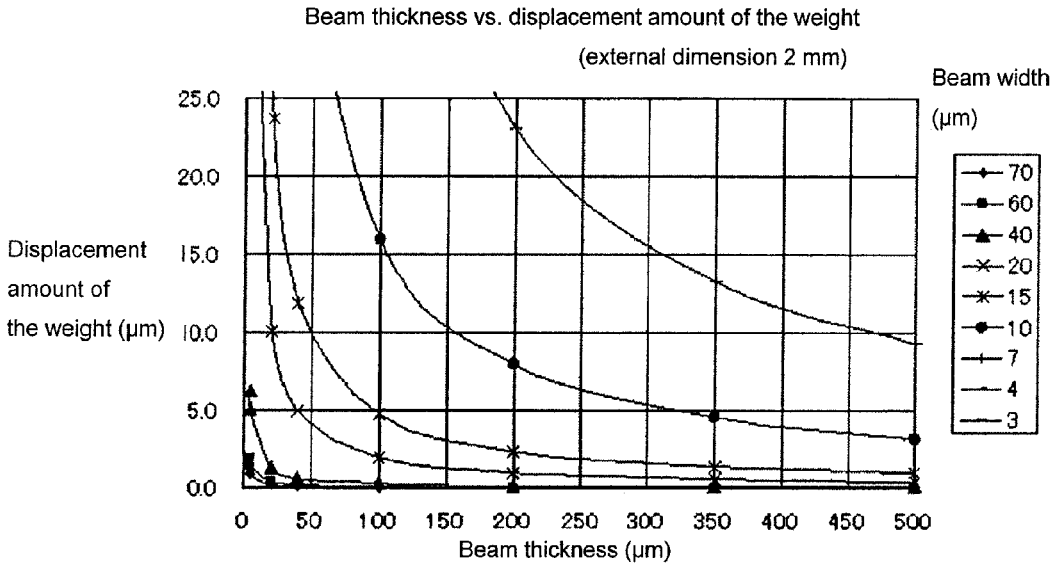
FIG. 11 is a graph showing results of the second simulation on an acceleration switch having an external dimension of 2 mm.
FIG. 12 is a table showing the results of the second simulation on the acceleration switch having an external dimension of 2 mm.

The graph of FIG. 11 shows the beam thickness (horizontal axis), the beam width (line type), and the displacement amount of the weight (vertical axis) in the case where the respective conditions of the acceleration switch having an external dimension of 2 mm were set and an acceleration of 1 G (9.8 N) was applied as the acceleration a in the planar direction (x direction) of FIG. 9. The table of FIG. 12 shows the displacement amounts of the weight under various conditions of the beam thickness and the beam width, in which the hatched parts show the condition that the weight is brought into contact with the counter electrode under the condition of the electrode interval of 1 μm. Note that, the condition of the electrode interval of 1 μm corresponds to the lower limit value of the electrode interval which can be produced by a silicon etching process.

Next, from the above-mentioned conditions of the electrode interval, the beam width, and the beam thickness and from the results of the second simulation, analysis is made on conditions necessary for the acceleration switch having an external dimension of 2 mm.

First, a lower limit value of the electrode interval which can be produced by a silicon etching process is 1 μm, and hence a lower limit value of the electrode interval is defined to 1 μm. In the case where the electrode interval is too wide, it is necessary to ensure the gap between the weight and the counter electrode as well as the gap between the weight and the beam and the gap between the beam and the support portion, and hence an upper limit value of the electrode interval is defined to 20 μm. This range of the electrode interval, that is, the range of 1 μm or more and 20 μm or less, is defined as a first condition of the acceleration switch.

The beam width also has a lower limit value which can be produced by the silicon etching process, which is 4 μm. Therefore, the lower limit value of the beam width is defined to 4 μm as a second condition of the acceleration switch.

The beam thickness also has a lower limit value for ensuring impact resistance when falling. When a large beam width is formed, the beam thickness needs to be formed small in order to ensure the displacement amount of the weight. On the other hand, when the beam thickness is formed too small, in particular, the impact resistance against acceleration applied in the vertical direction (z direction) illustrated in FIG. 9 cannot be ensured. Therefore, the lower limit value of the beam thickness for ensuring the impact resistance in the vertical direction is defined to 5 μm as a third condition of the acceleration switch.

Further, in the acceleration switch having an external dimension of 2 mm, in order to realize an acceleration switch having a sensitivity of 1 G or more, it is necessary to ensure a displacement amount of the weight of 1 μm or more. The beam width and the beam thickness that satisfy this condition are a beam width and a beam thickness corresponding to the hatched parts in the table of FIG. 12. Those are defined as a fourth condition of the acceleration switch including the second condition and the third condition of the acceleration switch described above. Specifically, the fourth condition is that the beam width is in the range of 4 μm or more and 60 μm or less and the beam thickness is in the range of 5 μm or more and 500 μm or less. The upper limit value of the beam thickness is defined by the above-mentioned desired condition that the thickness of the silicon substrate is 500 μm or less. For ensuring a displacement amount of the weight, it is advantageous to form the beam thickness to be smaller than the thickness of the weight, and hence an actual upper limit value of the beam thickness is defined to be equal to or less than the thickness of the weight. Note that, even if the upper limit value of the electrode interval is defined to 20 μm, in the case where the beam width is formed larger than the electrode interval, it is necessary to ensure a space of the beam correspondingly, and hence a more preferred upper limit value of the beam width as the condition of realizing the acceleration switch having an external dimension of 2 mm is 20 μm or less.

[Conditions of Beam of Acceleration Switch—Third Simulation]

Next, a third simulation assuming a more compact acceleration switch having the structure illustrated in FIGS. 8 and 9 is performed to analyze optimum conditions of the beam. Specifically, conditions of an acceleration switch having an external dimension of 1 mm (square) are set, and various conditions of the beam width and the beam thickness are varied to obtain displacement amounts of the weight under various conditions. In this manner, analysis is made on the optimum conditions of the beam to define the optimum conditions of the beam of the acceleration switch.

First, in the acceleration switch illustrated in FIG. 8, a displacement amount δ of the weight in the x direction measured when an acceleration of 1 G is applied to the acceleration switch having an external dimension of 1 mm in the X direction is calculated based on Expression (1) above. Regarding the conditions of Expression (1) in the third simulation, the conditions of the properties of silicon as the materials of the beam and the weight are set based on the conditions of the first simulation, and other conditions are set based on respective conditions of the acceleration switch having an external dimension of 1 mm described below.

Respective conditions of acceleration switch with external dimension of 1 mm (square) (unit: μm)

Inner radius of weight ($r_2$): 77.5

Outer radius of weight ($r_1$): 380

Beam width (w): variable

Electrode interval (35): unlimited

Beam thickness (h): variable

Weight thickness (H): 350

Using the conditions of the acceleration switch having an external dimension of 1 mm, the third simulation based on Expression (1) above was performed under various conditions, to thereby determine the conditions of the beam width w and the beam thickness h satisfying a displacement amount of the weight effective as an acceleration switch. Results of the third simulation are shown in a graph of FIG. 13 and a table of FIG. 14.

Figures 13, 14:
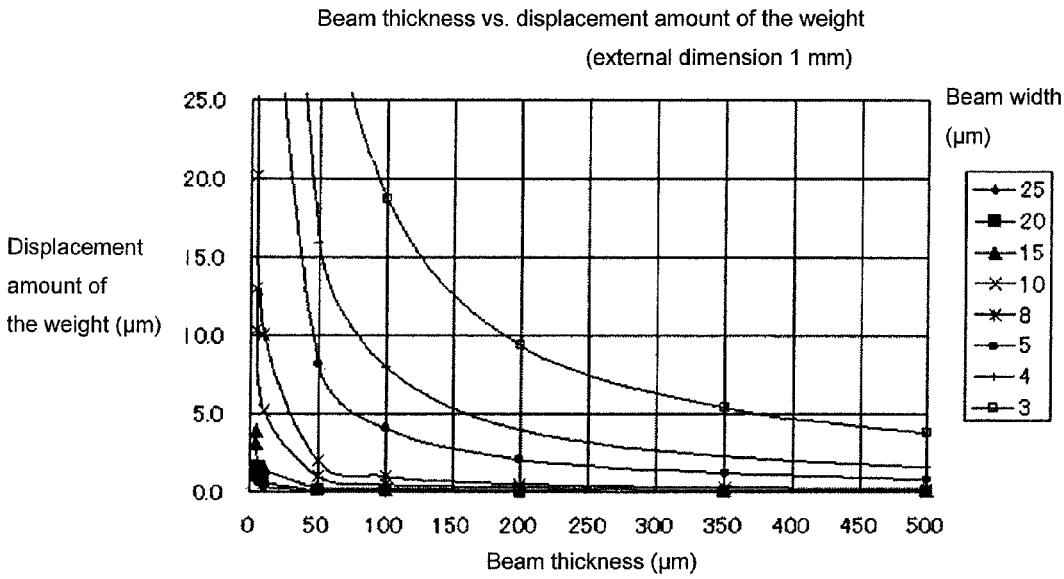
FIG. 13 is a graph showing results of the third simulation on an acceleration switch having an external dimension of 1 mm.
FIG. 14 is a table showing the results of the third simulation on the acceleration switch having an external dimension of 1 mm.

The graph of FIG. 13 shows the beam thickness (horizontal axis), the beam width (line type), and the displacement amount of the weight (vertical axis) in the case where the respective conditions of the acceleration switch having an external dimension of 1 mm were set and an acceleration of 1 G was applied as the acceleration a in the planar direction (X direction) of FIG. 9. The table of FIG. 14 shows the displacement amounts of the weight under various conditions of the beam thickness and the beam width, in which the hatched parts show the condition that the weight is brought into contact with the counter electrode under the condition of the electrode interval of 1 μm. Note that, the condition of the electrode interval of 1 μm corresponds to the lower limit value of the electrode interval which can be produced by a silicon etching process.

Next, from the above-mentioned conditions of the electrode interval, the beam width, and the beam thickness and from the results of the third simulation, analysis is made on conditions necessary for the acceleration switch having an external dimension of 1 mm.

As described above, the lower limit value of the electrode interval which can be produced by a silicon etching process is 1 μm, and hence a lower limit value of the electrode interval is defined to 1 μm. In the case where the electrode interval is too wide, it is necessary to ensure the gap between the weight and the counter electrode as well as the gap between the weight and the beam and the gap between the beam and the support portion, and hence an upper limit value of the electrode interval is defined to 20 μm. Regarding the electrode interval, the range of 1 μm or more and 20 μm or less is defined as a first condition of the acceleration switch.

As described above, regarding the beam width, a lower limit value of 4 μm of the beam width which can be produced by a silicon etching process is defined as a second condition of the acceleration switch.

As described above, regarding the beam thickness, a lower limit value of 5 μm of the beam thickness necessary for ensuring impact resistance when falling is defined as a third condition of the acceleration switch.

Further, in the acceleration switch having an external dimension of 1 mm, in order to realize an acceleration switch having a sensitivity of 1 G or more, it is necessary to ensure a displacement amount of the weight of 1 μm or more. The beam width and the beam thickness that satisfy this condition are a beam width and a beam thickness corresponding to the hatched parts in the table of FIG. 14. Those are defined as a fifth condition of the acceleration switch including the second condition and the third condition of the acceleration switch described above. Specifically, the fifth condition is that the beam width is in the range of 4 μm or more and 20 μm or less and the beam thickness is in the range of 5 μm or more and 500 μm or less. The upper limit value of the beam thickness is defined by the above-mentioned desired condition that the thickness of the silicon substrate is 500 μm or less. For ensuring a displacement amount of the weight, it is advantageous to form the beam thickness to be smaller than the thickness of the weight, and hence an actual upper limit value of the beam thickness is defined to be equal to or less than the thickness of the weight.

Figure 15:
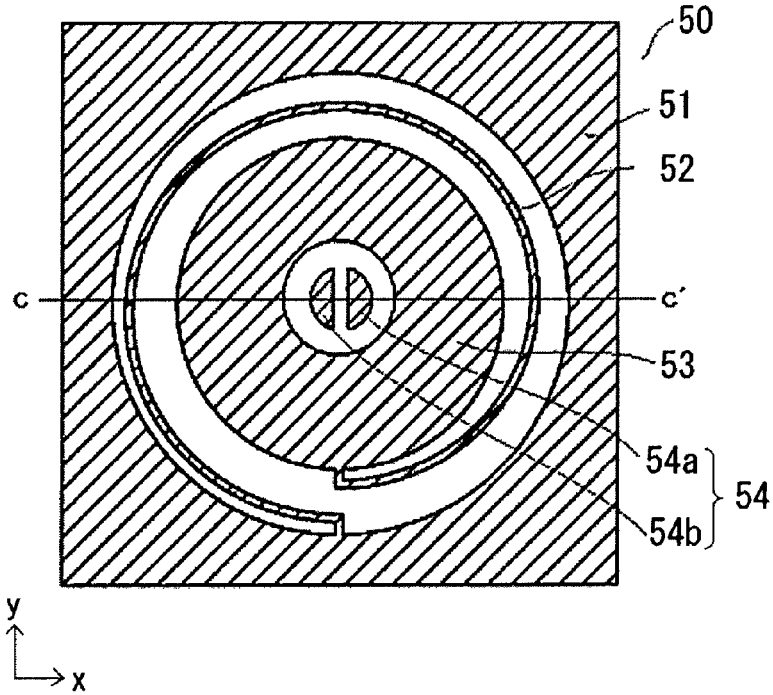
FIG. 15 is a cross-sectional view of an acceleration switch for detecting a vibration direction in the x direction.
Figure 16:
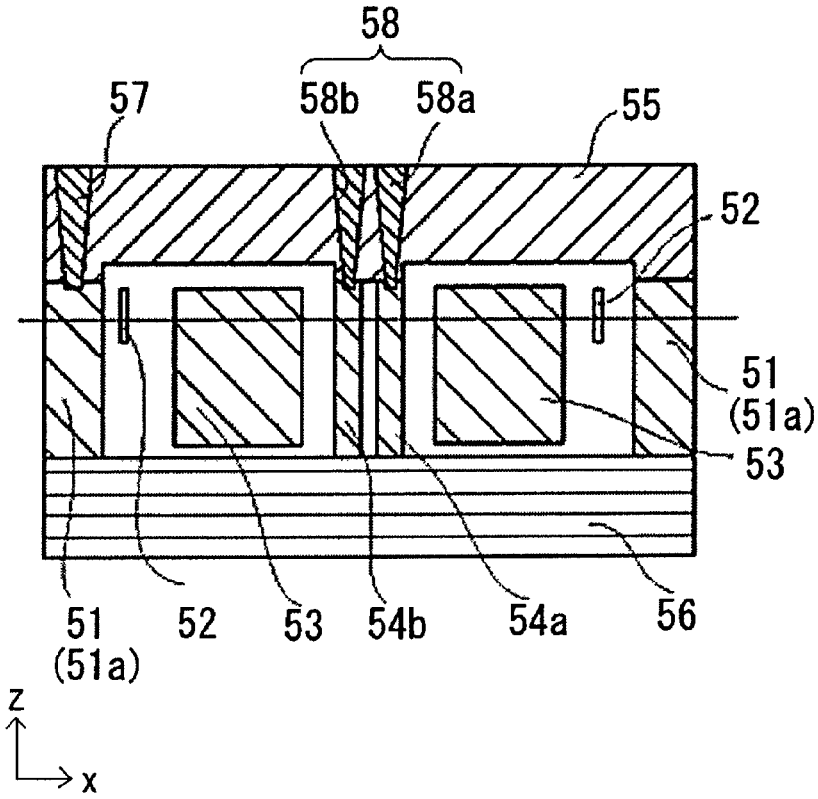
FIG. 16 is a vertical cross-sectional view of the acceleration switch taken along the plane C-C' of the acceleration switch of FIG. 15.

Another embodiment of the present invention is described with reference to FIGS. 15 to 17. FIG. 15 is a cross-sectional view of an acceleration switch 50 in which a counter electrode is divided into a plurality of electrodes so as to detect vibrations in a plurality of directions. Note that, a first substrate 55 serving as a cap layer is present on the cross-section and a third substrate 56 serving as a support layer is present thereunder. FIG. 16 is a vertical cross-sectional view taken along the plane A-A' of the acceleration switch illustrated in FIG. 15. FIG. 16 includes the first substrate 55 and the third substrate 56. FIG. 15 corresponds to the cross-section taken along the plane B-B' of FIG. 16. Comparing the acceleration switch 50 and the acceleration switch 10 illustrated in FIG. 1, a support portion 51*a*, a beam 52, and a weight (mass body) 53 have the same configurations, but there are differences in that the acceleration switch 50 includes a counter electrode group 54 formed of a plurality of electrode portions 54*a* and 54*b* which are arranged along the inner side surface of the weight in accordance with vibration detection directions of the acceleration switch, that the acceleration switch 50 further includes through electrode portions 58*a* and 58*b* of a second through electrode group 58, which corresponds to a second through electrode and is provided with respect to the counter electrode group 54, and that the acceleration switch 50 includes the counter electrode group 54 and the first substrate 55 including the through electrode groups.

Next, the operation of the acceleration switch 50 is described with reference to an explanatory diagram of FIG. 17. First, when acceleration is applied to the acceleration switch in the arrow direction Px1, the overall acceleration switch except for the weight moves in the arrow direction Px1. The weight supported by the beam, on the other hand, does not move because the acceleration is not directly applied to the weight. Thus, the electrode portion 54*a* disposed in the space inside the weight and the weight 53 are brought into contact with each other. In this manner, electrical conduction is ensured between the weight 53 and the electrode portion 54*a*, and, as illustrated in FIGS. 15 and 16, a first through electrode 57 and the first through electrode portion 58*a* are electrically connected to each other. The weight 53 and the electrode portion 54*b*, on the other hand, are not brought into contact with each other, and hence the first through electrode and the through electrode portion 58*b* are not electrically connected to each other.

Figure 17:
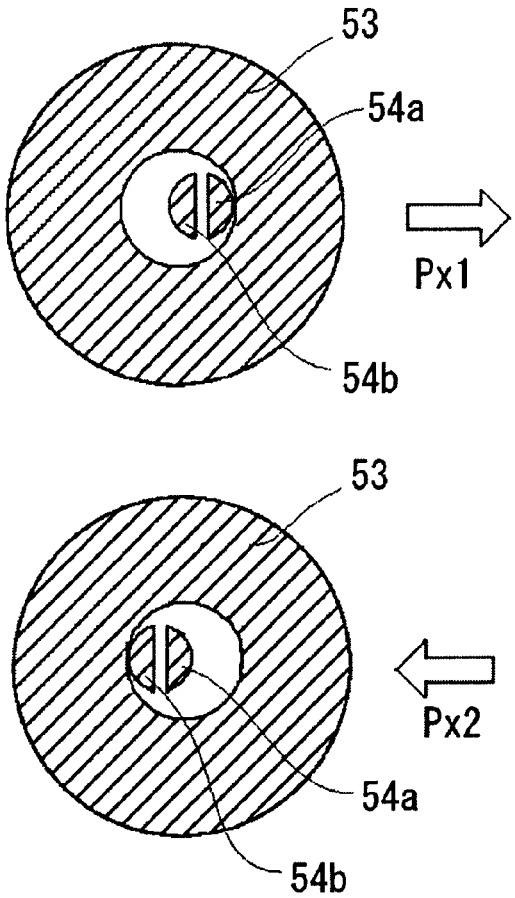
FIG. 17 is an explanatory diagram illustrating an operation of the acceleration switch of FIG. 15.

When acceleration is applied to the acceleration switch illustrated in FIG. 17 in the arrow direction Px2 which is the direction opposite to the arrow direction Px1, the overall acceleration switch except for the weight 53 moves in the arrow direction Px2 so that the electrode portion 54*b* and the weight 53 are brought into contact with each other. In this manner, electrical conduction is ensured between the weight 53 and the electrode portion 54*b*, and the through electrode 57 and the through electrode portion 58*b* are electrically connected to each other. The weight 53 and the electrode portion 54*a*, on the other hand, are not brought into contact with each other, and hence the first through electrode 57 and the through electrode portion 58*a* are not electrically connected to each other.

Therefore, when the first through electrode 57 and the through electrode portions 58*a* and 58*b* of the second through electrode group 58 of the acceleration switch 50 are connected to an external circuit so that the external circuit detects the electrical conduction between the first through electrode 57 and the through electrode portion 58*a* or the electrical conduction between the first through electrode 57 and the through electrode portion 58*b*, it is possible to detect vibration having a certain value or more and also detect the vibration direction, thus enabling the detection of the vibration direction and the tilt direction with respect to the acceleration switch.

Figure 18:
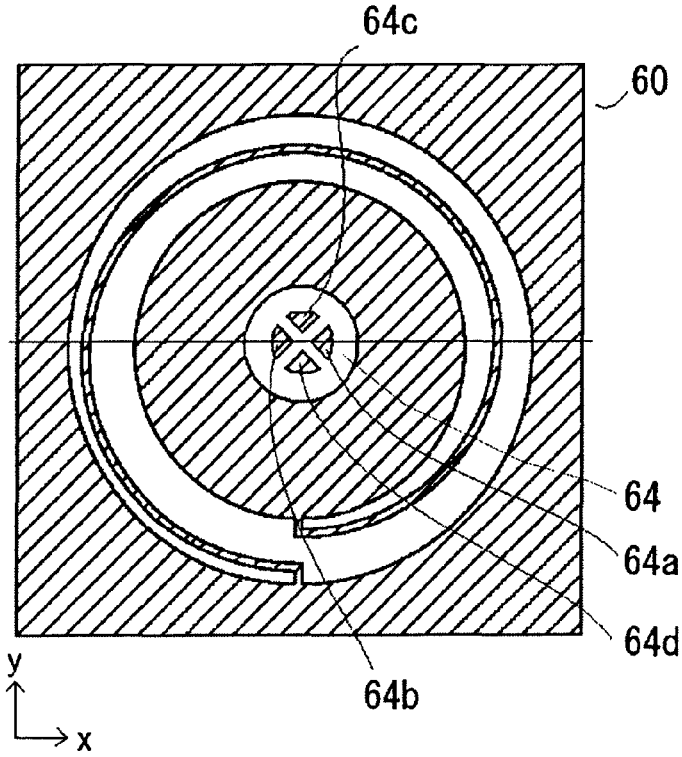
FIG. 18 is a cross-sectional view of an acceleration switch for detecting vibration directions in the x and y directions.
Figure 19:
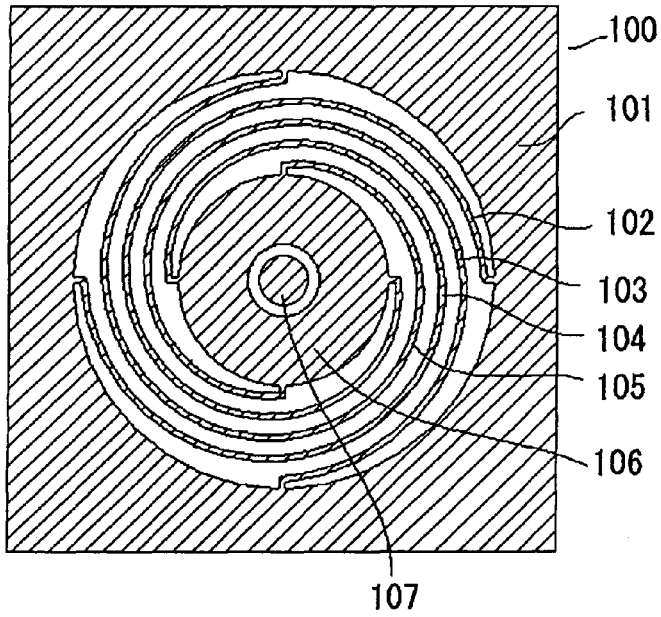
Fig.19 PRIOR ART
FIG. 19 is a top view illustrating a configuration of a conventional acceleration switch.

In addition, in the case of detecting the vibration direction more finely, the acceleration switch may include a necessary number of plurality of electrode portions which are contactable with the inner side surface of the weight and are divided in the radial direction and arranged in the circumferential direction. With this configuration, the vibration direction can be detected. For example, in the case of detecting four directions of acceleration, as illustrated in an acceleration switch 60 of FIG. 18, the counter electrode 14 of the acceleration switch 10 may be replaced with a counter electrode group 64 including electrode portions 64*a* to 64*d* which are arranged in the circumferential direction along the inner side surface of the weight in accordance with the vibration detection directions, and further, the first substrate 15 may be replaced with a first substrate (not shown) including a second through electrode group connected to respective electrode surfaces.

It is noted that the technical scope of the present invention is not intended to be limited to the foregoing embodiments, and variations can be made thereto within the range not departing from the gist of the present invention. In particular, the technical scope of the present invention is not intended to limit the external dimension of the acceleration switch to a 2-mm square or a 1-mm square and limit the sensitivity of the acceleration switch to 1 G. Various changes can also be made depending on the size of the acceleration switch, the sensitivity assumed when designing the acceleration switch, and other conditions within the range not departing from the gist of the present invention.

Reference Signs List

| | |
|---|---|
| 10, 20, 30, 40, 50, 60 | acceleration switch |
| 11, 21, 31, 41, 51 | second substrate |
| 12, 22, 32, 42, 52 | beam |
| 13, 23, 33, 53 | weight |
| 14, 34 | counter electrode |
| 15, 55 | first substrate |
| 16, 56 | third substrate |
| 17, 57 | second through electrode (support portion side) |
| 18, 58 | second through electrode (counter electrode side) |
| 100 | conventional acceleration switch |

The invention claimed is:

1. An acceleration switch comprising:

a first substrate including first and second through electrodes each having one end for electrical connection to an external circuit;

a second substrate laminated to the first substrate, the second substrate including a mass body having a space, an single arc-shaped beam supporting the mass body, a support portion supporting the arc-shaped beam and being electrically connected to another end of one of the first and second through electrodes, and a counter electrode disposed in the space of the mass body and being electrically connected to another end of one of the other of the first and second through electrodes, an electrode interval corresponding to a distance between an inner side surface of the mass body and an outer side surface of the counter electrode being in the range of 1 μm to 20 μm; and a third substrate laminated to the second substrate;

wherein the arc-shaped beam is configured to warp when an inertia force resulting from acceleration received by the acceleration switch is applied to the mass body.

2. An acceleration switch according to claim 1, wherein the arc-shaped beam is arranged so as to surround the mass body; and wherein the support portion is disposed at a periphery of the mass body.

3. An acceleration switch according to claim 1, wherein a thickness h of the arc-shaped beam and a width w of the arc-shaped beam are set based on the following expression:

$$\delta \propto \frac{1}{Ehw^3}$$

where δ represents a displacement amount of the mass body corresponding to the electrode interval, and E represents the Young's modulus of a material for the arc-shaped beam.

4. An acceleration switch according to claim 1, wherein a thickness h of the arc-shaped beam and a width w of the arc-shaped beam are set based on the following expression:

$$\delta \propto \sigma(r_1^2 - r_2^2)H \cdot a \cdot \frac{R^3}{Ehw^3} \cdot (1 - \nu^2)$$

where δ represents a displacement amount of the mass body corresponding to the electrode interval, σ represents a density of a material of the mass body, $r_1$ represents an outer radius of the mass body, $r_2$ represents a radius of the space of the mass body, H represents a thickness of the mass body, a represents the acceleration received by the acceleration switch, R represents a radius of the arc-shaped beam, E represents the Young's modulus of a material of the arc-shaped beam, and ν represents a Poisson's ratio of the material of the arc-shaped beam.

5. An acceleration switch according to claim 1, wherein the counter electrode includes a plurality of electrode portions.

6. An electronic device comprising: the acceleration switch according to claim 1; and a circuit for detecting a detection signal output from the acceleration switch and performing a predetermined operation in accordance with the detection signal.

7. An acceleration switch, comprising:

a mass body having a space therein;

a single arc-shaped beam for supporting the mass body and arranged so as to surround the mass body, the arc-shaped beam being adapted to warp by inertia force applied to the mass body when the acceleration switch receives an acceleration;

a support portion for supporting the arc-shaped beam, the support portion being disposed at a periphery of the mass body in a state of securing the arc-shaped beam; and a counter electrode disposed in the space of the mass body for detecting a contact with the mass body when the acceleration switch receives the acceleration, an electrode interval corresponding to a distance between an inner side surface of the mass body and an outer side surface of the counter electrode being 1 μm or more and 20 μm or less;

wherein a thickness h of the arc-shaped beam and a width w of the arc-shaped beam are set based on the following expression:

$$\delta \propto \frac{1}{Ehw^3}$$

where δ represents a displacement amount of the mass body, E represents the Young's modulus of a material for the arc-shaped beam, and the displacement amount δ satisfies a condition of being 1 μm or more and 20 μm or less corresponding to the electrode interval;

wherein the arc-shaped beam has one end connected to the mass body and another end connected to the support portion; and wherein a distance between the one end of the arc-shaped beam and the another end of the arc-shaped beam is larger than a distance between the counter electrode and an inner surface of the mass body.

8. An acceleration switch according to claim 7, wherein the width of the arc-shaped beam is 4 μm or more and 60 μm or less.

9. An acceleration switch according to claim 7, wherein the thickness of the arc-shaped beam is 5 μm or more and 500 μm or less, the thickness of the arc-shaped beam being equal to or smaller than a thickness of the mass body.

10. An acceleration switch according to claim 7, wherein an external dimension of an acceleration switch main portion including the support portion, the mass body, the arc-shaped beam, and the counter electrode is 0.5 mm or more and 3 mm or less.

11. An acceleration switch according to claim 7, wherein an external dimension of an acceleration switch main portion including the support portion, the mass body, the arc-shaped beam, and the counter electrode is 0.5 mm or more and 1.5 mm or less; wherein the width of the arc-shaped beam is 4 μm or more and 20 μm or less; and wherein the thickness of the arc-shaped beam is 5 μm or more and 500 μm or less, the thickness of the arc-shaped beam being equal to or smaller than a thickness of the mass body.

12. An acceleration switch according to claim 7, further comprising first, second and third substrates laminated with one another, the second substrate including the mass body, the counter electrode, the arc-shaped beam, and the support portion; wherein the first substrate includes a first through electrode having one end electrically connected to one of the support portion and the counter electrode and a second through electrode having one end electrically connected to the other of the support portion and the counter electrode, each of the first and second through electrodes having another end for electrical connection to an external circuit; and wherein the first substrate and the third substrate are bonded to the support portion and the counter electrode included in the second substrate.

13. An acceleration switch according to claim 7, wherein the counter electrode includes a plurality of electrode portions.

14. An electronic device comprising: the acceleration switch according to claim 7; and a circuit for detecting a detection signal output from the acceleration switch and performing a predetermined operation in accordance with the detection signal.

15. An acceleration switch, comprising:

a mass body having a space therein;

a single arc-shaped beam for supporting the mass body and arranged so as to surround the mass body, the arc-shaped beam being adapted to warp by inertia force applied to the mass body when the acceleration switch receives an acceleration;

a support portion for supporting the arc-shaped beam, the support portion being disposed at a periphery of the mass body in a state of securing the arc-shaped beam; and a counter electrode disposed in the space of the mass body for detecting a contact with the mass body when the acceleration switch receives the acceleration, an electrode interval corresponding to a distance between an inner side surface of the mass body and an outer side surface of the counter electrode being 1 μm or more and 20 μm or less;

wherein a thickness h of the arc-shaped beam and a width w of the arc-shaped beam are set based on the following expression:

$$\delta \propto \frac{1}{Ehw^3}$$

where δ represents a displacement amount of the mass body, E represents the Young's modulus of a material for the arc-shaped beam, and the displacement amount δ satisfies a condition of being 1 μm or more and 20 μm or less corresponding to the electrode interval; and wherein the arc-shaped beam has an end connected to the mass body, a distance between the support portion and the one end of the arc-shaped beam being larger than a distance between the counter electrode and an inner surface of the mass body.

16. An acceleration switch according to claim 15, wherein the width of the arc-shaped beam is 4 μm or more and 60 μm or less.

17. An acceleration switch according to claim 15, wherein the thickness of the arc-shaped beam is 5 μm or more and 500 μm or less, the thickness of the arc-shaped beam being equal to or smaller than a thickness of the mass body.

18. An acceleration switch, comprising:

a mass body having a space therein;

a single arc-shaped beam for supporting the mass body and arranged so as to surround the mass body, the arc-shaped beam being adapted to warp by inertia force applied to the mass body when the acceleration switch receives an acceleration;

a support portion for supporting the arc-shaped beam, the support portion being disposed at a periphery of the mass body in a state of securing the arc-shaped beam; and a counter electrode disposed in the space of the mass body for detecting a contact with the mass body when the acceleration switch receives the acceleration, an electrode interval corresponding to a distance between an inner side surface of the mass body and an outer side surface of the counter electrode being 1 μm or more and 20 μm or less;

wherein a thickness h of the arc-shaped beam and a width w of the arc-shaped beam are set based on the following expression:

$$\delta \propto \frac{1}{Ehw^3} \quad 1$$

where δ represents a displacement amount of the mass body, E represents the Young's modulus of a material for the arc-shaped beam, and the displacement amount δ satisfies a condition of being 1 μm or more and 20 μm or less corresponding to the electrode interval; and wherein the arc-shaped beam has one end connected to the support portion, a distance between the mass body and the one end of the arc-shaped beam being larger than a distance between the counter electrode and an inner surface of the mass body.

19. An acceleration switch according to claim 18, wherein the width of the arc-shaped beam is 4 μm or more and 60 μm or less.

20. An acceleration switch according to claim 18, wherein the thickness of the arc-shaped beam is 5 μm or more and 500 μm or less, the thickness of the arc-shaped beam being equal to or smaller than a thickness of the mass body.

* * * * *